US010180662B2

(12) United States Patent
Ogasawara et al.

(10) Patent No.: US 10,180,662 B2
(45) Date of Patent: Jan. 15, 2019

(54) ELECTRONIC TIMEPIECE AND PROGRAM

(71) Applicant: SEIKO INSTRUMENTS INC., Chiba-shi, Chiba (JP)

(72) Inventors: Kenji Ogasawara, Chiba (JP); Tomohiro Ihashi, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 182 days.

(21) Appl. No.: 15/175,455

(22) Filed: Jun. 7, 2016

(65) Prior Publication Data

US 2016/0378066 A1 Dec. 29, 2016

(30) Foreign Application Priority Data

Jun. 26, 2015 (JP) ..... 2015-128816

(51) Int. Cl.
*G04G 9/00* (2006.01)
*G04R 20/00* (2013.01)

(52) U.S. Cl.
CPC ..... *G04G 9/0076* (2013.01); *G04R 20/00* (2013.01)

(58) Field of Classification Search
CPC ..... G04G 5/00; G04G 9/00; G04G 9/0076; G04R 20/00; G04R 20/02
USPC ..... 368/21
See application file for complete search history.

(56) References Cited

U.S. PATENT DOCUMENTS 6,359,839 B1 * 3/2002 Schenk ..... G04B 19/26 368/16
8,284,633 B2 * 10/2012 Lazaridis ..... G04G 13/026 368/109
8,295,126 B2 * 10/2012 Wood ..... G04G 11/00 368/21
8,514,667 B2 * 8/2013 Akiyama ..... G04R 20/06 368/47
8,817,579 B2 * 8/2014 Scott ..... G04G 21/04 368/21
2014/0192624 A1 * 7/2014 Ono ..... G04R 20/18 368/46
2016/0018792 A1 * 1/2016 Hasegawa ..... G04R 20/02 368/47

OTHER PUBLICATIONS

Abstract, Publication No. JP 2014-182047, Publication date Sep. 29, 2014.

* cited by examiner

*Primary Examiner* — Sean Kayes
(74) *Attorney, Agent, or Firm* — Adams & Wilks

(57) ABSTRACT

An electronic timepiece includes a first display unit and a second display unit that display time. A receiving unit receives a time modification command including time information for modifying a first time displayed by the first display unit. A control unit outputs a first change command for automatically changing the first time displayed by the first display unit into a modified time different from a second time displayed by the second display unit based on the received time information, and outputs a second change command for changing the second time displayed by the second display unit into the first time displayed by the first display unit before the first time is changed into the modified time. A display drive unit changes the first time and the second time based on the first change command and the second change command, respectively, from the control unit.

13 Claims, 9 Drawing Sheets

20: MOBILE APPARATUS
23: APPARATUS CONTROL UNIT
21: FIRST COMMUNICATION UNIT
22: SECOND COMMUNICATION UNIT
10: ELECTRONIC TIMEPIECE
12: STORAGE UNIT
17: CONTROL UNIT
11: COMMUNICATION UNIT
13: TIME MEASUREMENT CIRCUIT
14: MOTOR DRIVER
151: MOTOR
152: MOTOR
18: POWER SUPPLY UNIT
181: SOLAR CELL
182: STORAGE BATTERY

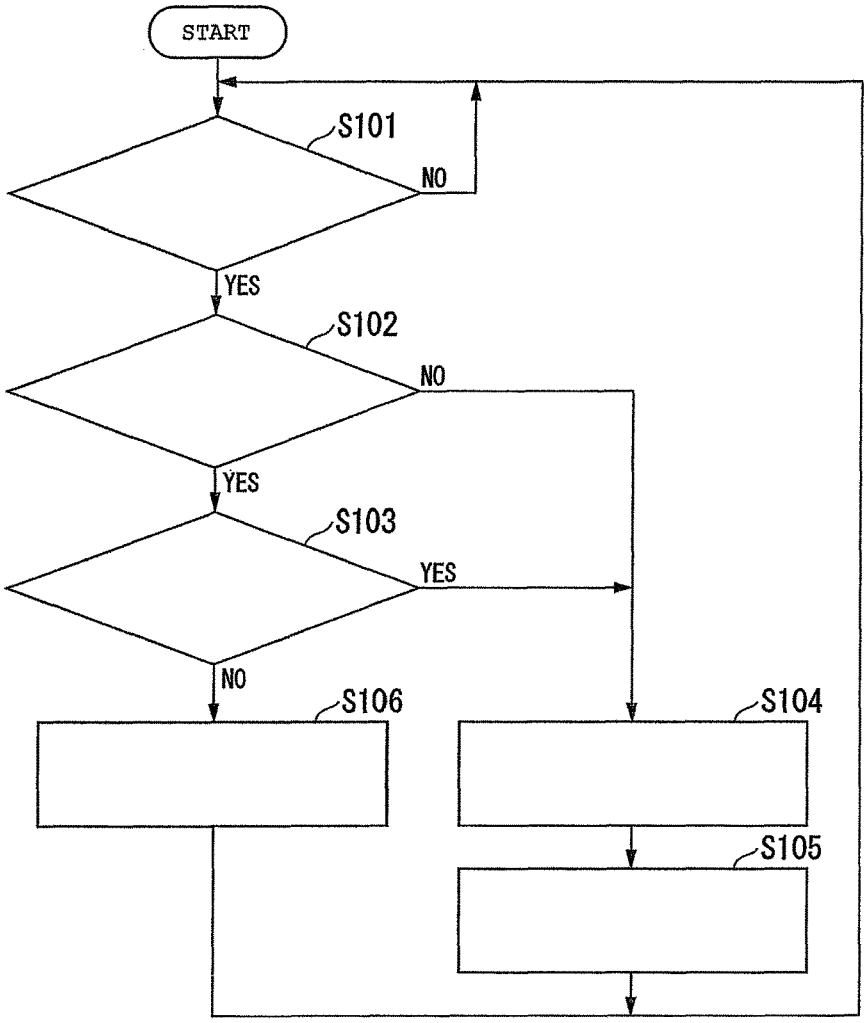

S101: IS TIME INFORMATION RECEIVED?
S102: IS TIME OF SECOND DISPLAY UNIT HOME TIME?
S103: IS TIME BASED ON TIME INFORMATION HOME TIME?
S104: OUTPUT FIRST CHANGE COMMAND FOR CHANGING TIME OF FIRST DISPLAY UNIT INTO TIME BASED ON TIME INFORMATION
S105: OUTPUT SECOND CHANGE COMMAND FOR CHANGING TIME OF SECOND DISPLAY UNIT INTO TIME BEFORE CHANGE OF FIRST DISPLAY UNIT
S106: OUTPUT FIRST CHANGE COMMAND FOR CHANGING TIME OF FIRST DISPLAY UNIT INTO TIME BASED ON TIME INFORMATION

FIG. 4

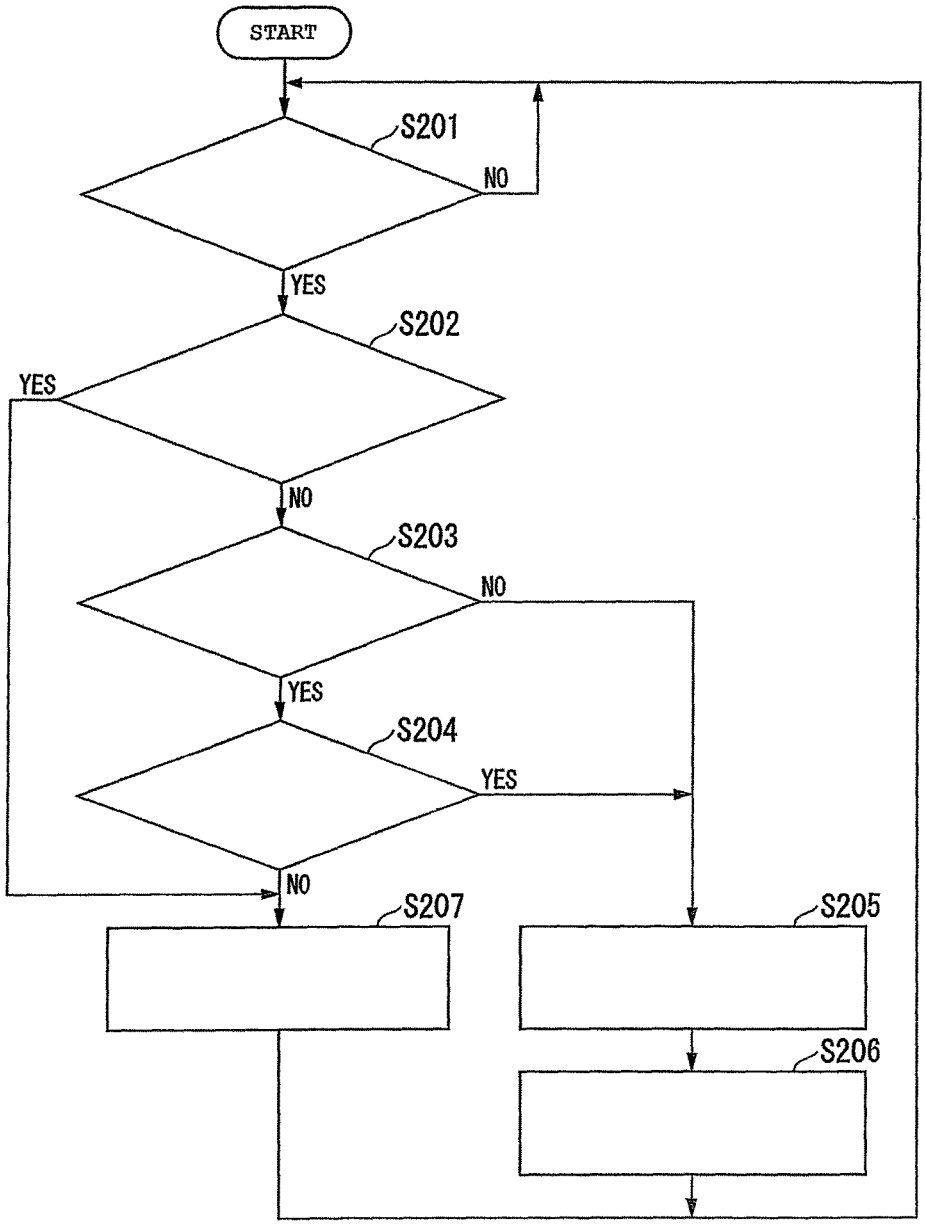

S201: IS TIME INFORMATION RECEIVED?
S202: IS DIFFERENCE BETWEEN TIME BASED ON TIME INFORMATION AND TIME OF FIRST DISPLAY UNIT EQUAL TO OR LOWER THAN PREDETERMINED VALUE?
S203: IS TIME OF SECOND DISPLAY UNIT HOME TIME?
S204: IS TIME BASED ON TIME INFORMATION HOME TIME?
S205: OUTPUT FIRST CHANGE COMMAND FOR CHANGING TIME OF FIRST DISPLAY UNIT INTO TIME BASED ON TIME INFORMATION
S206: OUTPUT SECOND CHANGE COMMAND FOR CHANGING TIME OF SECOND DISPLAY UNIT INTO TIME BEFORE CHANGE OF FIRST DISPLAY UNIT
S207: OUTPUT FIRST CHANGE COMMAND FOR CHANGING TIME OF FIRST DISPLAY UNIT INTO TIME BASED ON TIME INFORMATION

FIG.5

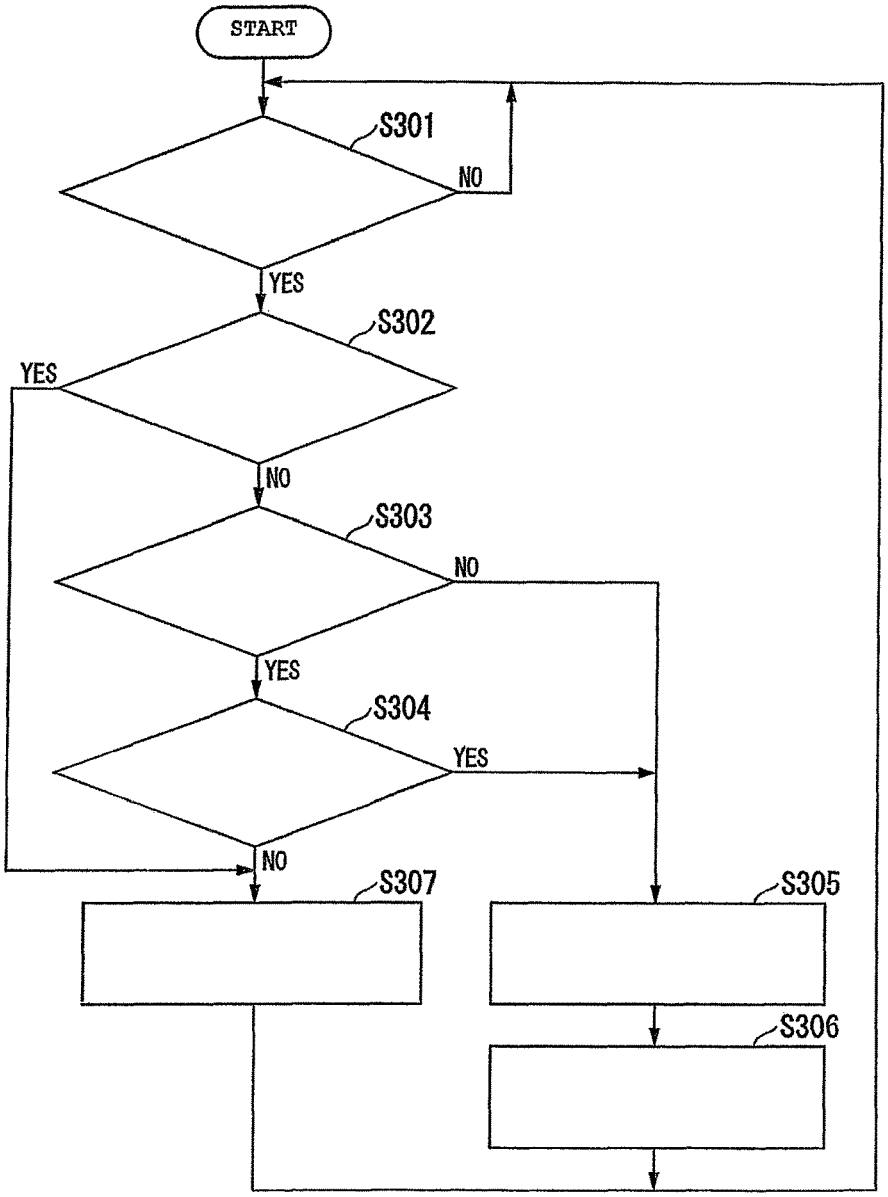

S301: IS TIME INFORMATION RECEIVED?
S302: IS TIME ZONE INFORMATION INCLUDED IN TIME INFORMATION SAME AS PREVIOUS INFORMATION?
S303: IS TIME OF SECOND DISPLAY UNIT HOME TIME?
S304: IS TIME BASED ON TIME INFORMATION HOME TIME?
S305: OUTPUT FIRST CHANGE COMMAND FOR CHANGING TIME OF FIRST DISPLAY UNIT INTO TIME BASED ON TIME INFORMATION
S306: OUTPUT SECOND CHANGE COMMAND FOR CHANGING TIME OF SECOND DISPLAY UNIT INTO TIME BEFORE CHANGE OF FIRST DISPLAY UNIT
S307: OUTPUT FIRST CHANGE COMMAND FOR CHANGING TIME OF FIRST DISPLAY UNIT INTO TIME BASED ON TIME INFORMATION

FIG. 6

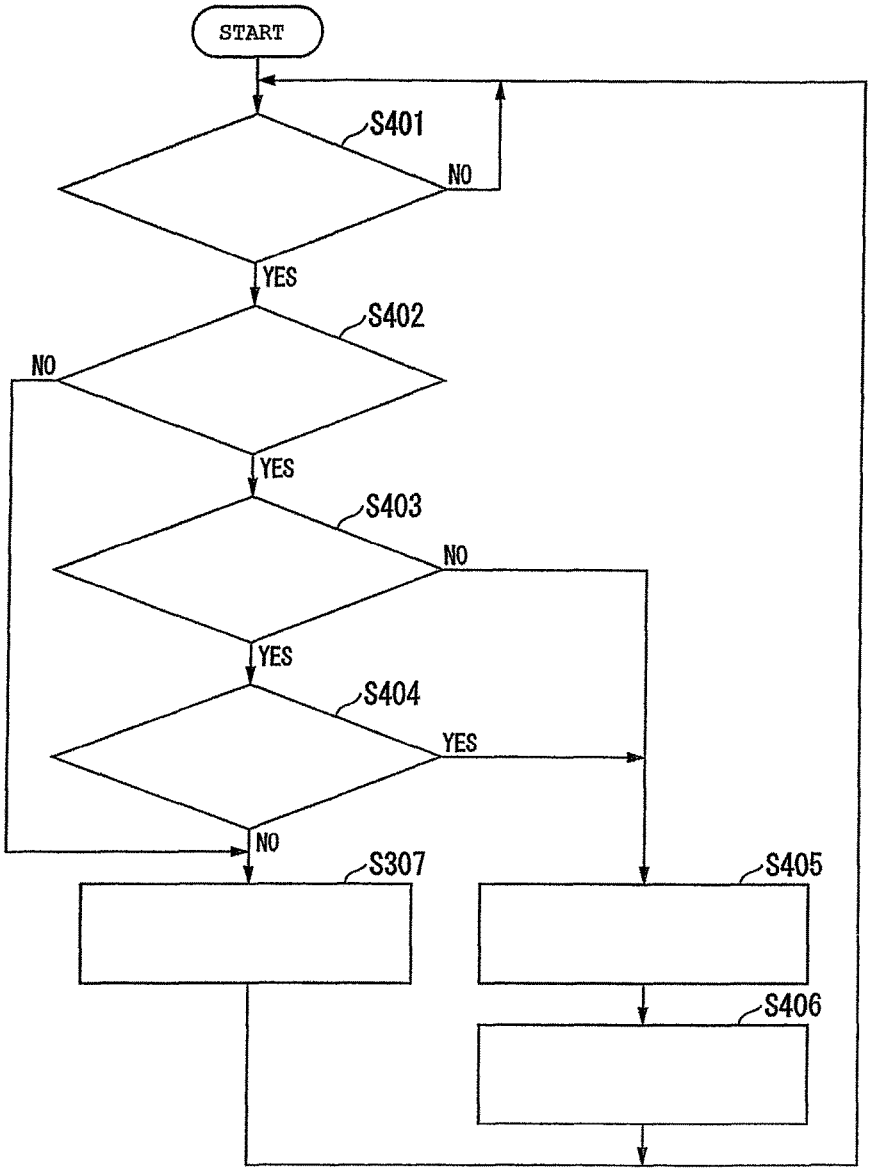

S401: IS TIME INFORMATION RECEIVED?
S402: IS SUMMER TIME INFORMATION INCLUDED IN TIME INFORMATION SAME AS PREVIOUS INFORMATION?
S403: IS TIME OF SECOND DISPLAY UNIT HOME TIME?
S404: IS TIME BASED ON TIME INFORMATION HOME TIME?
S405: OUTPUT FIRST CHANGE COMMAND FOR CHANGING TIME OF FIRST DISPLAY UNIT INTO TIME BASED ON TIME INFORMATION
S406: OUTPUT SECOND CHANGE COMMAND FOR CHANGING TIME OF SECOND DISPLAY UNIT INTO TIME BEFORE CHANGE OF FIRST DISPLAY UNIT
S407: OUTPUT FIRST CHANGE COMMAND FOR CHANGING TIME OF FIRST DISPLAY UNIT INTO TIME BASED ON TIME INFORMATION

FIG.7

20: MOBILE APPARATUS
23: APPARATUS CONTROL UNIT
21: FIRST COMMUNICATION UNIT
22: SECOND COMMUNICATION UNIT
10a: ELECTRONIC TIMEPIECE
12: STORAGE UNIT
17a: CONTROL UNIT
11: COMMUNICATION UNIT
13: TIME MEASUREMENT CIRCUIT
14a: MOTOR DRIVER
151: MOTOR
152: MOTOR
153: MOTOR
18: POWER SUPPLY UNIT
181: SOLAR CELL
182: STORAGE BATTERY

20: MOBILE APPARATUS
23: APPARATUS CONTROL UNIT
21: FIRST COMMUNICATION UNIT
22: SECOND COMMUNICATION UNIT
10b: ELECTRONIC TIMEPIECE
12: STORAGE UNIT
17a: CONTROL UNIT
11: COMMUNICATION UNIT
13: TIME MEASUREMENT CIRCUIT
15b: LIQUID CRYSTAL DRIVE UNIT
18: POWER SUPPLY UNIT
181: SOLAR CELL
182: STORAGE BATTERY

ELECTRONIC TIMEPIECE AND PROGRAM

BACKGROUND OF THE INVENTION

Field of the Invention

The present invention relates to an electronic timepiece and to a computer-readable recording medium that records a program for performing functions of the electronic timepiece.

Background Art

An electronic timepiece is known which includes multiple time display units that can display time, displays a different time in each time display unit, and selectively exchanges time to be displayed (for example, refer to JP-A-2014-182047).

SUMMARY OF THE INVENTION

However, for example, in a case where time of an area at which a user stays is exchanged with time of an area with a high frequency of use, it is necessary for a user of the aforementioned electronic timepiece to set an area with a high frequency of use in advance and to exchange time to be displayed by an operation of a switch included in the electronic timepiece. In this way, the aforementioned electronic timepiece may require a complicated operation to be performed by a user, in order to obtain a desired time.

The present invention is to solve the aforementioned problem, and an objective thereof is to provide an electronic timepiece and a program which can increase convenience.

According to an aspect of the present invention, there is provided an electronic timepiece including a time display unit which includes a first time display unit and a second time display unit that display time; a control unit which outputs a first change command for changing first time that is displayed by the first time display unit into time based on received time information which is information on time, and outputs a second change command for changing second time that is displayed by the second time display unit into time before change which is time displayed in the first time display unit before the first time is changed into time based on the time information; and a display drive unit which changes the first time, based on the first change command that is output from the control unit, and changes the second time, based on the second change command that is output from the control unit.

In addition, in the aspect, the control unit may output the second change command, in a case where the first change command is caused by movement to other areas, and may prohibit outputting the second change command, in a case where the first change command is not caused by movement to other areas.

In addition, in the aspect, the control unit may prohibit outputting the second change command, in a case where a difference between time based on the time information and the time before change is equal to or lower than a predetermined value.

In addition, in the aspect, information indicating time after modification may be included in the time information, and the control unit may output the first change command, based on the information indicating time after modification.

In addition, in the aspect, time zone information indicating an area in which common standard time is used may be included in the time information, and the control unit may prohibit outputting the second change command, in a case where the received time zone information is the same as the previously received time zone information.

In addition, in the aspect, summer time information on a change of standard time corresponding to a season may be included in the time information, and the control unit may prohibit outputting the second change command, in a case where the first time is changed on the basis of the summer time information.

In addition, in the aspect, the control unit may prohibit outputting the second change command, in a case where the second time is time corresponding to a predetermined area which is determined in advance, and time based on the time information is different from time corresponding to the predetermined area.

In addition, in the aspect, the time display unit may further include a third time display unit, and the control unit may output a third change command for changing third time which is displayed by the third time display unit into the time before change, in a case where the second time is time corresponding to the predetermined area and time based on the time information is different from time corresponding to the predetermined area.

In addition, in the aspect, the electronic timepiece may further include a receiving unit which receives the time information by wireless communication; and a solar cell which generates power for operating at least the receiving unit and the display drive unit.

According to another aspect of the present invention, there is provided a computer-readable non-transitory recording medium for recording a program readable by a computer serving as an electronic timepiece including a time display unit which includes a first time display unit and a second time display unit that display time, and a display drive unit which changes time that is displayed in the time display unit, including causing the display drive unit to output a first change command for changing first time that is displayed by the first time display unit into time based on received time information which is information on time; and causing the display drive unit to output a second change command for changing second time that is displayed by the second time display unit into time before change which is time displayed in the first time display unit before the first time is changed into time based on the time information.

According to the present invention, times which are displayed in the first time display unit and the second time display unit are appropriately changed based on the time information which is received, and thus, it is possible to increase convenience.

BRIEF DESCRIPTION OF THE DRAWINGS

FIG. 4 is a flowchart illustrating an example of an operation of the electronic timepiece according to the first embodiment.

FIG. 5 is a flowchart illustrating a first modification example of the operation of the electronic timepiece according to the first embodiment.

FIG. 6 is a flowchart illustrating a second modification example of the operation of the electronic timepiece according to the first embodiment.

FIG. 7 is a flowchart illustrating a third modification example of the operation of the electronic timepiece according to the first embodiment.

DETAILED DESCRIPTION OF THE INVENTION

Hereinafter, an electronic timepiece according to an embodiment of the invention will be described with reference to the accompanying drawings.

First Embodiment

Figure 1:
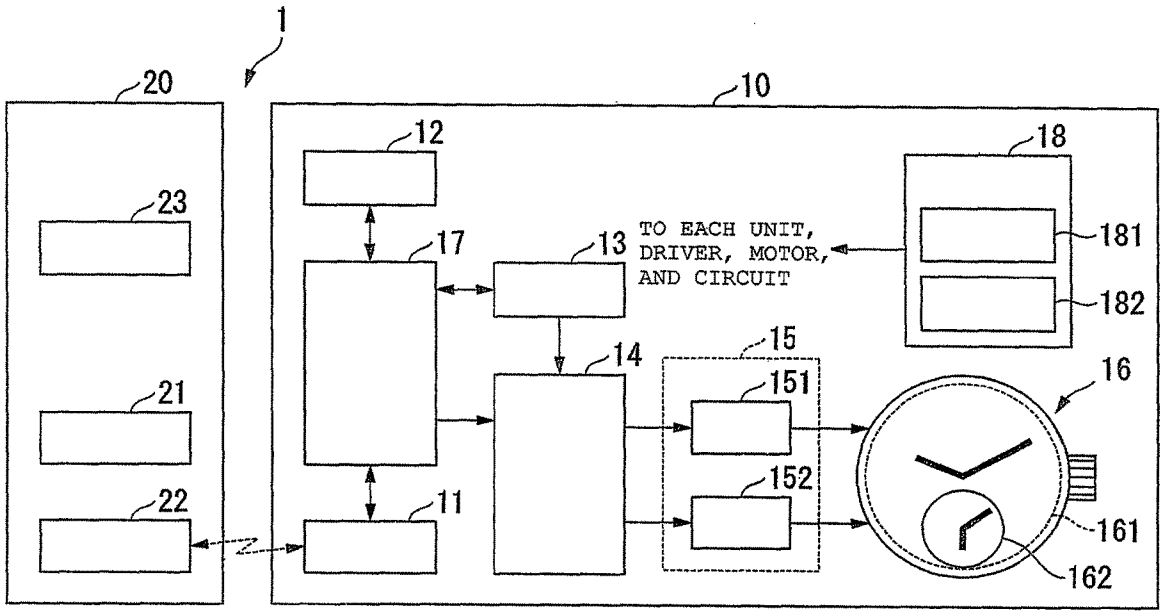
FIG. 1 is a block diagram illustrating an example of a timepiece system according to a first embodiment.

FIG. 1 is a schematic block diagram illustrating a timepiece system 1 according to a first embodiment.

As illustrated in FIG. 1, the timepiece system 1 includes an electronic timepiece 10 and a mobile apparatus 20.

The electronic timepiece 10 is, for example, a timepiece such as a wristwatch, and can be connected to the mobile apparatus 20 through wireless communication. The electronic timepiece 10 includes a communication unit 11, a storage unit 12, a time measurement circuit 13, a motor driver 14, a display drive unit 15, a time display unit 16, a control unit 17, and a power supply unit 18.

In the present embodiment, a case where the electronic timepiece 10 is an analog timepiece which displays time using a dial and hands of a timepiece will be described as an example.

The communication unit 11 (an example of a receiving unit) performs wireless communication with the mobile apparatus 20, using an interface such as Bluetooth (registered trademark). The communication unit 11 receives time information on time from the mobile apparatus 20, after being arbitrarily set to a communicable state. Here, the time information includes time to which display time displayed in, for example, the time display unit 16 is modified. The communication unit 11 outputs the received time information to the control unit 17.

The storage unit 12 stores a variety of information which is used for a variety of processing of the electronic timepiece 10. The storage unit 12 stores information indicating an area of homes (hereinafter, referred to as a home area) with a high frequency of use, or information on whether or not time corresponding to the home area is included in the display time which is displayed by the time display unit 16. In the present embodiment, the home area is an example of a predetermined area which is determined in advance.

The time measurement circuit 13 is configured by an integrated circuit in which, for example, an oscillation circuit, a register circuit, a counter circuit, an interface circuit, and the like are embedded, and measures time. In addition, the time measurement circuit 13 outputs a drive command to advance time which is displayed in the time display unit 16 to the motor driver 14, according to the time measurement results.

The motor driver 14 outputs a motor drive signal which drives the display drive unit 15 (a motor 151 and a motor 152).

The display drive unit 15 performs a drive operation for advancing time which is displayed on the time display unit 16, or for changing (modifying) time. The display drive unit 15 advances time which is displayed on the time display unit 16, for example, based on the drive command which is output from the time measurement circuit 13 to the motor driver 14. In addition, the display drive unit 15 changes (modifies) time which is displayed on the time display unit 16, for example, based on a time change command which is output from the control unit 17 that will be described below to the motor driver 14. In addition, the display drive unit 15 includes the motor 151 and the motor 152.

The motor 151 and the motor 152 are, for example, stepping motors. The motor 151 advances or changes time by moving hands of a first display unit 161 which will be described below. In addition, the motor 152 advances or changes time by moving hands of a second display unit 162 which will be described below.

The time display unit 16 includes, for example, a dial and hands, and displays time by angles of the hands on the dial. The hands may include, for example, an hour hand indicating the hour, a minute hand indicating the minute, and a second hand indicating the second. In addition, the time display unit 16 includes the first display unit 161 and the second display unit 162 which display time.

The first display unit 161 (an example of a first time display unit) is disposed, for example, in a central portion of the time display unit 16, and displays first time by angles of the hands on the dial.

The second display unit 162 (an example of a second time display unit) is disposed, for example, in a lower portion of the time display unit 16, and displays second time by angles of the hands on the dial.

The control unit 17 is a processor including, for example, a central processing unit (CPU) or the like, and comprehensively controls the electronic timepiece 10. For example, the control unit 17 outputs a first change command for changing first time displayed by the first display unit 161 into time based on time information on the time received by the communication unit 11. That is, for example, in a case where the communication unit 11 receives a time modification command including the time information, the control unit 17 generates time after change to which time is changed based on the time information. Then, the control unit 17 outputs the change command (first change command) which changes the first time that is displayed by the first display unit 161 into the time after change, to the motor driver 14. In addition, the control unit 17 outputs a second change command for changing the second time that is displayed by the second display unit 162 into the time before change which is displayed on the first display unit 161 before being changed into time based on the time information, to the motor driver 14.

In this way, in a case where the communication unit 11 receives a time modification command, the control unit 17 changes (modifies) the first time which is displayed by the first display unit 161 into the time after change based on time information. Then, furthermore, the control unit 17 changes (modifies) the second time which is displayed by the second display unit 162 into the time before change. That is, the control unit 17 moves the first time which is displayed before a change and is displayed by the first display unit 161 into the second time which is displayed by the second display unit 162.

For example, it is assumed that time of the home area is displayed in the first time, and information indicating that the first time is time corresponding to the home area is stored in the storage unit 12. In this state, in a case where a user carrying the electronic timepiece 10 and the mobile apparatus 20 moves to an area (local area) other than the home area, if the communication unit 11 receives a modification command for modifying the time to time corresponding to a related area from the mobile apparatus 20, the control unit 17 changes the first time into the modification time, based on the modification command, and changes the second time into the time before change of the first time. In addition, the control unit 17 stores the information indicating that the second time is time corresponding to the home area, in the storage unit 12. Accordingly, in the electronic timepiece 10, the first display unit 161 displays time corresponding to a movement destination area, and the second display unit 162 displays time corresponding to the home area.

In addition, in a case where the second time is time corresponding to the home area and the time after change is different from time corresponding to the home area, the control unit 17 prohibits outputting the second modification command. That is, in a case where the second time is time corresponding to the home area and a user carrying the electronic timepiece 10 and the mobile apparatus 20 moves to an area (local area) other than the home area, the control unit 17 does not change the second time into the time before change of the first time, and maintains display of time corresponding to the home area.

It is assumed that the aforementioned time information includes, for example, information indicating time after modification. In this case, the control unit 17 outputs the first change command and the second change command, based on the information indicating the time after modification. That is, the control unit 17 generates time after change based on the information indicating the time after modification, and outputs the first change command for changing the first time into the time after change, to the motor driver 14. Furthermore, the control unit 17 outputs the second change command for changing the second time into the time before change which is displayed on the first display unit 161 before being changed into the time based on the time information, to the motor driver 14.

The power supply unit 18 supplies each unit with power which operates each unit of the electronic timepiece 10. The power supply unit 18 includes, for example, a solar cell 181 and a storage battery 182.

The solar cell 181 generates power by light, charges the generated power in the storage battery 182, and supplies each unit of the electronic timepiece 10 with the power. The solar cell 181 generates power for operating, for example, at least the communication unit 11 and the display drive unit 15.

The storage battery 182 is, for example, a rechargeable secondary battery, a capacitor with a large capacity, or the like, accumulates (charges) the power which is generated by the solar cell 181, and supplies each unit of the electronic timepiece 10 with the power, in a case where the power generated by the solar cell 181 is reduced.

The mobile apparatus 20 is, for example, a mobile phone such as a smart phone, and can be connected to the electronic timepiece 10 by wireless communication. The mobile apparatus transmits a time modification command including the aforementioned time information to the electronic timepiece 10 by wireless communication. The mobile apparatus 20 includes a first communication unit 21, a second communication unit 22, and an apparatus control unit 23.

The first communication unit 21 performs wireless communication by an interface such as, a third-generation mobile communication system (3G), a fourth-generation mobile communication system (4G), or a wireless local area network (LAN). For example, the first communication unit 21 wirelessly communicates with a server device of a mobile phone company (mobile phone carrier) which provides mobile phone service, and acquires time information on an area at which the mobile apparatus 20 exists.

The second communication unit 22 wirelessly communicates with the electronic timepiece 10 by an interface such as Bluetooth (registered trademark). The second communication unit 22 transmits time information on time to the electronic timepiece 10.

The apparatus control unit 23 is, for example, a processor including a CPU or the like, and comprehensively controls the mobile apparatus 20. For example, in a case where the first communication unit 21 acquires time information on an area at which the mobile apparatus 20 exists, the apparatus control unit 23 modifies time of a timepiece function of the mobile apparatus 20, based on the acquired time information. Furthermore, the apparatus control unit 23 commands the second communication unit 22 to transmit a time modification command including time information to the electronic timepiece 10.

Next, an operation of the timepiece system 1 according to the present embodiment will be described with reference to the accompanying drawings.

Here, display examples of an operation of the electronic timepiece 10 according to the present embodiment will be first described with reference to FIG. 2A to FIG. 3C.

Figures 2A, 2B, 2C:
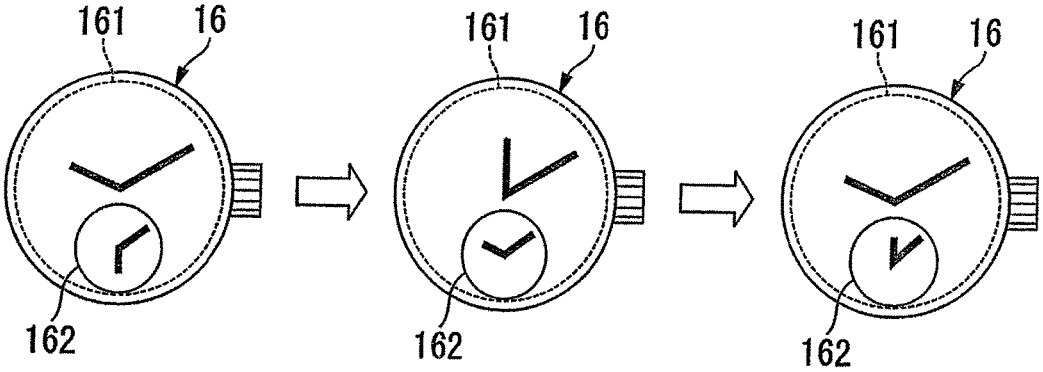
FIGS. 2A to 2C are first views illustrating display examples of an electronic timepiece according to the first embodiment.

FIGS. 2A to 2C are first views illustrating the display examples of the electronic timepiece 10 according to the present embodiment.

FIG. 2A illustrates the display example of the electronic timepiece 10 in a case where a user carrying the electronic timepiece 10 and the mobile apparatus 20 stays at a home area.

The example illustrated in FIG. 2A represents that time which is first time displayed by the first display unit 161 and corresponds to the home area is "eight minutes after ten", and time which is second time displayed by the second display unit 162 and corresponds to a local area is "eight minutes after six".

FIG. 2B illustrates the display example of the electronic timepiece 10 in a case where a user carrying the electronic timepiece 10 and the mobile apparatus 20 moves to a local area (first local area). In this case, the first communication unit 21 of the mobile apparatus 20 acquires time information (for example, time information which is "eight minutes after twelve" corresponding to the first local area) from a server device of a mobile phone carrier, and the apparatus control unit 23 modifies time of the timepiece function of the mobile apparatus 20 to "eight minutes after twelve". Then, the apparatus control unit 23 commands the second communication unit 22 to transmit a time modification command (a modification command to modify the time to "eight minutes after twelve") including the time information to the electronic timepiece 10.

In a case where the communication unit 11 receives the time modification command, the control unit 17 of the electronic timepiece 10 changes (modifies) the first time displayed by the first display unit 161 into the time after change based on the time information. In this example, the control unit 17 displays the time after change of "eight minutes after twelve" corresponding to the first local area in the first display unit 161 of the time display unit 16. In addition, the control unit 17 displays the time of "eight minutes after ten" (time before change) corresponding to the home area in the second display unit 162.

Specifically, the control unit 17 outputs a first change command for changing the first time displayed by the first display unit 161 into "eight minutes after twelve" to the motor driver 14, and the motor driver 14 outputs a drive signal which changes the first time into "eight minutes after twelve" to the motor 151. In addition, the control unit 17 outputs the second change command for changing the second time displayed by the second display unit 162 into "eight minutes after ten" to the motor driver 14, and the motor driver 14 outputs a drive signal which changes the second time into "eight minutes after ten" to the motor 152. As a result, as illustrated in FIG. 2B, in the time display unit 16, the first display unit 161 displays the time after change of "eight minutes after twelve" corresponding to the first local area, and the second display unit 162 displays the time of "eight minutes after ten" corresponding to the home area.

In addition, FIG. 2C illustrates the display example of the electronic timepiece 10 in a case where a user carrying the electronic timepiece 10 and the mobile apparatus 20 moves to a home area again. In this case, the first communication unit 21 of the mobile apparatus 20 acquires time information (time information which is "eight minutes after ten" corresponding to the home area) from a server device of a mobile phone carrier, and the apparatus control unit 23 modifies time of the timepiece function of the mobile apparatus 20 to "eight minutes after ten". Then, the apparatus control unit 23 commands the second communication unit 22 to transmit a time modification command (a modification command to modify the time to "eight minutes after ten") including the time information to the electronic timepiece 10.

In a case where the communication unit 11 receives the time modification command, the control unit 17 of the electronic timepiece 10 changes (modifies) the first time displayed by the first display unit 161 into the time after change based on the time information. In this example, the control unit 17 displays the time after change of "eight minutes after ten" corresponding to the home area in the first display unit 161 of the time display unit 16. In addition, the control unit 17 displays the time of "eight minutes after twelve" (time before change) corresponding to the first local area in the second display unit 162.

The control unit 17 may determine that the user moves to the home area again based on the information stored in the storage unit 12. Also, the, control unit 17 may compare the time after change (in this case, "eight minutes after ten") based on the modification command with the second time (in this case, "eight minutes after ten") which is displayed by the second display unit 162, and determine that the user moves to the home area again. For example, in a case where a difference between the time after change based on the modification command and the second time displayed by the second display unit 162 is less than a predetermined value, the control unit 17 determines that the user moves to the home area again.

Figures 3A, 3B, 3C:
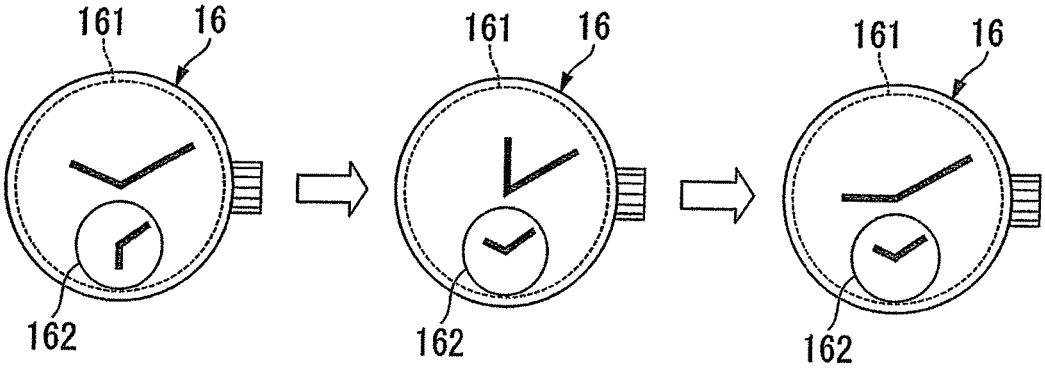
FIGS. 3A to 3C are second views illustrating display examples of the electronic timepiece according to the first embodiment.

FIGS. 3A to 3C are second views illustrating display examples of the electronic timepiece 10 according to the present embodiment.

FIG. 3A illustrates the display example of the electronic timepiece 10 in a case where a user carrying the electronic timepiece 10 and the mobile apparatus 20 stays at the home area. In addition, FIG. 3B illustrates the display example of the electronic timepiece 10 in a case where a user carrying the electronic timepiece 10 and the mobile apparatus 20 moves to a local area (first local area). The display examples illustrated in FIG. 3A and FIG. 3B are the same as the display examples illustrated in FIG. 2A and FIG. 2B, and thus, description thereof will be omitted herein.

FIG. 3C illustrates the display example of the electronic timepiece 10 in a case where a user carrying the electronic timepiece 10 and the mobile apparatus 20 moves from the first local area to another local area (second local area). In this case, the first communication unit 21 of the mobile apparatus 20 acquires time information (time information which is "eight minutes after nine" corresponding to the second local area) from a server device of a mobile phone carrier, and the apparatus control unit 23 modifies time of the timepiece function of the mobile apparatus'20 to "eight minutes after nine". Then, the apparatus control unit 23 commands the second communication unit 22 to transmit a time modification command including the time information to the electronic timepiece 10.

In a case where the communication unit 11 receives the time modification command, the control unit 17 of the electronic timepiece 10 changes (modifies) the first time displayed by the first display unit 161 into the time after change based on the time information. In this example, the control unit 17 displays the time after change of "eight minutes after nine" corresponding to the second local area in the first display unit 161 of the time display unit 16.

In addition, this case corresponds to a case where the second time which is displayed by the second display unit 162 is time of "eight minutes after ten" corresponding to the home area, and the time after change is different from the time corresponding to the local area. Accordingly, the control unit 17 does not output the second change command for changing the second time to the motor driver 14, and maintains the current second time of "eight minutes after ten". As a result, in the time display unit 16, the first display unit 161 displays the time after change of "eight minutes after nine" corresponding to the second local area, and the second display unit 162 displays the time of "eight minutes after ten" corresponding to the home area, as illustrated in FIG. 3C.

As described above, in the electronic timepiece 10 according to the present embodiment, the first time which is displayed by the first display unit 161 is automatically changed into the time corresponding to an area to which a user carrying the electronic timepiece 10 and the mobile apparatus 20 moves, as illustrated in FIG. 2A to FIG. 3C. In addition, the electronic timepiece 10 according to the present embodiment displays time (for example, "eight minutes after ten") corresponding to the home area (an example of a predetermined area determined in advance) in one of the first display unit 161 and the second display unit 162, as illustrated in FIG. 2A to FIG. 3C.

Next, the sequence of an operation of the electronic timepiece 10 according to the present embodiment will be described with reference to FIG. 4.

FIG. 4 is a flowchart illustrating an example of the operation of the electronic timepiece 10 according to the present embodiment.

In FIG. 4, initially, the communication unit 11 of the electronic timepiece 10 is arbitrarily set to a communicable state, and thereafter, the control unit 17 of the electronic timepiece 10 determines whether or not time information is received (step S101). That is, the control unit 17 determines whether or not the communication unit 11 receives a time modification command including time information from the mobile apparatus 20. In a case where the communication unit 11 receives the time modification command including the time information from the mobile apparatus 20 (step S101: YES), the control unit 17 advances processing to step S102. In addition, in a case where the communication unit 11 does not receive the time modification command including the time information from the mobile apparatus 20 (step S101: NO), the control unit 17 returns processing to step S101, and repeats processing of step S101.

Subsequently, in step S102, the control unit 17 determines whether or not time of the second display unit 162 is home time. In FIG. 4, the time corresponding to the aforementioned home area is referred to as "home time". For example, the control unit 17 determines whether or not the second time which is displayed by the second display unit 162 is the home time, based on the information stored in the storage unit 12. In a case where the second time which is displayed by the second display unit 162 is the home time (step S102: YES), the control unit 17 advances processing to step S103. In addition, in a case where the second time which is displayed by the second display unit 162 is not the home time (step S102: NO), the control unit 17 advances processing to step S104.

Subsequently, in step S103, the control unit 17 determines whether or not the time (time after change) based on the time information is the home time. For example, the control unit 17 acquires the home time, based on the information stored in the storage unit 12, and determines whether or not the time after change is the home time. In a case where the time after change is the home time (step S103: YES), the control unit 17 advances processing to step S104. In addition, in a case where the time after change is not the home time (step S103: NO), the control unit 17 advances processing to step S106.

In step S104, the control unit 17 outputs the first change command for changing the time (first time) of the first display unit 161 into time (time after change) based on the aforementioned time information, to the motor driver 14. Accordingly, the first display unit 161 displays time which is modified.

In addition, subsequently, the control unit 17 outputs the second change command for changing the time (second time) of the second display unit 162 into the time (time before change) of the first display unit 161, to the motor driver 14 (step S105). Accordingly, the second display unit 162 displays the time (time before change) before being changed (before being modified) of the first display unit 161. The electronic timepiece 10 changes the time which is displayed by the time display unit 16 through the processing of step S104 and the processing of step S105, as illustrated in FIGS. 2A to 2C described above.

After processing of step S105, the control unit 17 returns processing to step S101.

In addition, in step S106, the control unit 17 outputs the first change command for changing the time (first time) of the first display unit 161 into the time (time after change) based on the aforementioned time information, to the motor driver 14. Accordingly, the first display unit 161 displays the time which is modified.

After processing in step S106, the control unit 17 prohibits outputting the second change command. That is, the control unit 17 does not change the time (second time) of the second display unit 162 into the time (time before change) of the first display unit 161. In this way, the control unit 17 prohibits outputting the second change command, in a case where the second time is the time corresponding to the home area and the time after change is different from the home time. The electronic timepiece 10 changes the time which is displayed by the time display unit 16 by the processing of step S106, as illustrated in FIG. 3B and FIG. 3C described above. After step S106 is processed, the control unit 17 returns processing to step S101.

Subsequently, modification examples of the processing of the electronic timepiece 10 according to the present embodiment will be described with reference to FIG. 5 to FIG. 7.

FIRST MODIFICATION EXAMPLE

In a first modification example according to the present embodiment, a case where the control unit 17 determines whether or not time modification is caused by movement to other areas, based on a difference between time after change and time before change, will be described as an example.

In the present modification example, in a case where a difference between time (time after change) based on time information and time before change which is displayed by the first display unit 161 is equal to or lower than a predetermined value (for example, equal to or lower than 15 minutes), the control unit 17 prohibits outputting the second modification command. That is, in a case where a difference between the aforementioned time after change and time before change is equal to or lower than a predetermined value, the control unit 17 determines that the time modification is not caused by movement to other areas (for example, the time modification is modification of a time measurement error of the time measurement circuit 13), and does not perform modification of the second time which is displayed by the second display unit 162. That is, in a case where the first change command is not caused by movement to other areas, the control unit 17 prohibits outputting the second change command.

In addition, in a case where a difference between the aforementioned time after change and the time before change is not equal to or lower than a predetermined value, the control unit 17 determines that time modification is caused by movement to other areas. That is, in a case where the first modification command is caused by movement to other areas, the control unit 17 outputs the second modification command.

FIG. 5 is a flowchart illustrating the first modification example of the operation of the electronic timepiece 10 according to the present embodiment.

In FIG. 5, initially, the communication unit 11 of the electronic timepiece 10 is arbitrarily set to a communicable state, and thereafter, the control unit 17 of the electronic timepiece 10 determines whether or not time information is received (step S201), in the same manner as in step S101 illustrated in FIG. 4 described above. For example, in a case where the communication unit 11 receives a time modification command including time information from the mobile apparatus 20 (step S201: YES), the control unit 17 advances processing to step S202. In addition, in a case where the communication unit 11 does not receive the time modification command including the time information from the mobile apparatus 20 (step S201: NO), the control unit 17 returns processing to step S201, and repeats processing of step S201.

Subsequently, in step S202, the control unit 17 determines whether or not a difference between the time based on the time information and the time of the first display unit 161 is equal to or lower than a predetermined value. That is, the control unit 17 determines whether or not a difference between time after change and time before change which is displayed by the first display unit 161 is equal to or lower than 15 minutes. In a case where the difference between the time after change and the time before change is equal to or lower than the predetermined value (for example, equal to or lower than 15 minutes) (step S202: YES), the control unit 17 determines that time modification is not caused by movement to other areas, and advances processing to step S207. In addition, in a case where the difference between the time after change and the time before change is not equal to or lower than the predetermined value (for example, equal to or lower than 15 minutes) (step S202: NO), the control unit 17 determines that time modification is caused by movement to other areas, and advances processing to step S203.

Subsequent processing from step S203 to step S207 is the same as the processing from step S102 to step S106 illustrated in FIG. 4 described above, and thus, description thereof will be omitted herein.

In a case where the control unit 17 determines that the time modification is not caused by movement to other areas, the control unit 17 outputs the first change command for changing the time (the first time) of the first display unit 161 into the time after change to the motor driver 14, in step S207. Then, in this case, the control unit 17 does not output the second change command to the motor driver 14.

Next, a second modification example of the processing of the electronic timepiece 10 according to the present embodiment will be described.

SECOND MODIFICATION EXAMPLE

In the second modification example according to the present embodiment, a case where the control unit 17 determines whether or not time modification is caused by movement to other areas, based on a time zone, will be described as an example.

In the present modification example, it is assumed that time zone information indicating an area which uses common standard time is included in the time information on the aforementioned time which is received from the mobile apparatus 20. In a case where the time zone information received from the mobile apparatus 20 through the communication unit 11 is the same as the time zone information previously received, the control unit 17 according to the present modification example prohibits outputting the second change command. The control unit 17 stores the received time zone information in the storage unit 12 as time zone information which is previously received. For example, the control unit 17 compares the time zone information which is currently received with the time zone information which is previously received and is stored in the storage unit 12, and determines whether or not the time modification is caused by movement to other areas.

Specifically, for example, in a case where the time zone information which is currently received coincides with the time zone information which is previously received and is stored in the storage unit 12, the control unit 17 determines that the time modification is not caused by movement to other areas, and does not perform the second time modification which is displayed by the second display unit 162. In addition, for example, in a case where the time zone information which is currently received does not coincide with the time zone information which is previously received and is stored in the storage unit 12, the control unit 17 determines that the time modification is caused by movement to other areas.

FIG. 6 is a flowchart illustrating the second modification example of the operation of the electronic timepiece 10 according to the present embodiment.

In FIG. 6, initially, the communication unit 11 of the electronic timepiece 10 is arbitrarily set to a communicable state, and thereafter, the control unit 17 of the electronic timepiece 10 determines whether or not the time information is received (step S301), in the same manner as in step S101 illustrated in FIG. 4 described above. In the present embodiment, time zone information is included in the time information. For example, in a case where the communication unit 11 receives a time modification command including the time information from the mobile apparatus 20 (step S301: YES), the control unit 17 advances processing to step S302. In addition, in a case where the communication unit 11 does not receive the time modification command including the time information from the mobile apparatus 20 (step S301: NO), the control unit 17 returns processing to step S301, and repeats processing of step S301.

Subsequently, in step S302, the control unit 17 determines whether or not the time zone information included in the time information is the same as the previous time zone information. That is, for example, the control unit 17 determines whether or not the currently received time zone information coincides with the previously received time zone information which is stored in the storage unit 12. In a case where the currently received time zone information coincides with the previously received time zone information (step S302: YES), the control unit 17 determines that the time modification is not caused by movement to other areas, and advances processing to step S307. In addition, in a case where the currently received time zone information does not coincide with the previously received time zone information (step S302: NO), the control unit 17 determines that the time modification is caused by movement to other areas, and advances processing to step S303.

Subsequent processing from step S303 to step S307 is the same as the processing from step S203 to step S207 illustrated in FIG. 5 described above, and thus, description thereof will be omitted herein.

In a case where the control unit 17 determines that the time modification is not caused by movement to other areas, the control unit 17 outputs the first change command for changing the time (the first time) of the first display unit 161 into the time after change to the motor driver 14, in step S307. Then, in this case, the control unit 17 does not output the second change command to the motor driver 14.

Next, a third modification example of the processing of the electronic timepiece 10 according to the present embodiment will be described.

THIRD MODIFICATION EXAMPLE

In the third modification example according to the present embodiment, a case where the control unit 17 determines whether or not time modification is caused by movement to other areas, based on summer time information, will be described as an example.

In the present modification example, it is assumed that summer time information on a change of standard time corresponding to a season is included in the aforementioned time information on the time which is received from the mobile apparatus 20. In a case where the first time which is displayed by the first display unit 161 is changed on the basis of the summer time information, the control unit 17 according to the present modification example prohibits outputting the second change command. For example, in a case where the summer time information received from the mobile apparatus 20 through the communication unit 11 is different from the previously received summer time information, the control unit 17 prohibits outputting the second change command. The control unit 17 makes the storage unit 12 store the received summer time information as the previously received summer time information. For example, the control unit 17 compares the currently received summer time information with the previously received summer time information which is stored in the storage unit 12, and determines whether or not the time modification is caused by movement to other areas.

Specifically, for example, in a case where the currently received summer time information does not coincide with the previously received summer time information which is stored in the storage unit 12, the control unit 17 determines that the time modification is not caused by movement to other areas, and does not perform modification of the second time which is displayed by the second display unit 162. In addition, for example, in a case where the currently received summer time information coincides with the previously received summer time information which is stored in the storage unit 12, the control unit 17 determines that the time modification is caused by movement to other areas.

FIG. 7 is a flowchart illustrating the third modification example of the operation of the electronic timepiece 10 according to the present embodiment.

In FIG. 7, initially, the communication unit 11 of the electronic timepiece 10 is arbitrarily set to a communicable state, and thereafter, the control unit 17 of the electronic timepiece 10 determines whether or not the time information is received (step S401), in the same manner as in step S101 illustrated in FIG. 4 described above. In the present modification example, the summer time information is included in the time information. For example, in a case where the communication unit 11 receives a time modification command including the time information from the mobile apparatus 20 (step S401: YES), the control unit 17 advances processing to step S402. In addition, in a case where the communication unit 11 does not receive the time modification command including the time information from the mobile apparatus 20 (step S401: NO), the control unit 17 returns processing to step S401, and repeats processing of step S401.

Subsequently, in step S402, the control unit 17 determines whether or not the summer time information included in the time information is the same as the previous summer time information. That is, for example, the control unit 17 determines whether or not the currently received summer time information coincides with the previously received summer time information which is stored in the storage unit 12. In a case where the currently received summer time information coincides with the previously received summer time information (step S402: YES), the control unit 17 determines that the time modification is caused by movement to other areas, and advances processing to step S403. In addition, in a case where the currently received summer time information does not coincide with the previously received summer time information (step S402: NO), the control unit 17 determines that the time modification is not caused by movement to other areas, and advances processing to step S407.

Subsequent processing from step S403 to step S407 is the same as the processing from step S203 to step S207 illustrated in FIG. 5 described above, and thus, description thereof will be omitted herein.

In a case where the control unit 17 determines that the time modification is not caused by movement to other areas, the control unit 17 outputs the first change command for changing the time (the first time) of the first display unit 161 into the time after change to the motor driver 14, in step S407. Then, in this case, the control unit 17 does not output the second change command to the motor driver 14.

In the description of the modification examples of the electronic timepiece 10 according to the aforementioned present embodiment, examples in which each of the first modification example to the third modification example is implemented alone are described, but the invention is not limited to those, and combinations of the respective modification examples may be implemented.

As described above, the electronic timepiece 10 according to the present embodiment includes the time display unit 16, the control unit 17, and the display drive unit 15. The time display unit 16 includes the first display unit 161 (first time display unit) and the second display unit 162 (second time display unit) which display time. The control unit 17 outputs the first change command, and outputs the second change command. Here, the first change command changes the first time which is displayed by the first display unit 161 into time based on the received time information on time. The second change command changes the second time which is displayed by the second display unit 162 into time displayed in the first display unit 161 before being changed into time based on the time information. The display drive unit 15 changes the first time, based on the first change command which is output from the control unit 17, and changes the second time, based on the second change command which is output from the control unit 17.

Accordingly, the electronic timepiece 10 according to the present embodiment appropriately changes the times which are displayed by the first display unit 161 and the second display unit 162, based on the received time information, and thus, it is possible to increase convenience.

For example, in a case where a user carrying the electronic timepiece 10 and the mobile apparatus 20 moves to other areas, the electronic timepiece 10 according to the present embodiment can automatically change the time which is displayed by the first display unit 161 into the time corresponding to a movement destination area, without requiring an operation by the user. Furthermore, the electronic timepiece 10 according to the present embodiment can simultaneously display the time corresponding to the movement destination area and the time of an area with a high frequency of use such as the home area which is displayed before movement. In this way, in order to obtain a desired time, the electronic timepiece 10 according to the present embodiment does not require a complicated operation to be performed by a user. In addition, since the user can simultaneously confirm the time corresponding to the movement destination area and the time of an area with a high frequency of use, the electronic timepiece 10 according to the present embodiment can have the increased convenience.

In addition, in the present embodiment, in a case where the first change command is caused by movement to other areas, the control unit 17 outputs the second change command, and in a case where the first change command is not caused by movement to other areas, the control unit 17 prohibits outputting the second change command.

In this way, in a case where the time is modified on the basis of movement to other areas, the electronic timepiece 10 according to the present embodiment changes the time which is displayed in the second display unit 162. Accordingly, in a case where the time is changed by modification or the like of a time measurement error of the time measurement circuit 13, the electronic timepiece 10 according to the present embodiment can prevent the time displayed in the second display unit 162 from being changed by mistake.

In addition, in the present embodiment, information (information such as "eight minutes after twelve") indicating time after modification is included in the time information. The control unit 17 outputs the first change command, based on the information indicating the time after modification which is received from the mobile apparatus 20 through the communication unit 11.

In this way, the control unit 17 can more easily output the first change command.

In addition, in the present embodiment, in a case where a difference between the time (time after change) based on the time information and the time before change is equal to or lower than a predetermined value (for example, equal to or lower than 15 minutes), the control unit 17 prohibits outputting the second modification command.

In this way, the electronic timepiece 10 according to the present embodiment can easily determine whether to modify the time on the basis of movement to other areas or not. Hence, the electronic timepiece 10 according to the present embodiment can prevent the time which is displayed in the second display unit 162 from being changed by mistake, with respect to modification of time which is not caused by movement to other areas. That is, the electronic timepiece 10 according to the present embodiment can more appropriately change the time which is displayed in the time display unit 16.

In addition, in the present embodiment, the time zone information indicating an area at which common standard time is used is included in the time information. In a case where the received time zone information is the same as the previously received time zone information, the control unit 17 prohibits outputting the second change command.

In this way, the electronic timepiece 10 according to the present embodiment can prevent the time which is displayed in the second display unit 162 from being changed by mistake, with respect to modification of time which is not caused by movement to other areas.

In addition, in the present embodiment, the summer time information on a change of the standard time corresponding to a season is included in the time information. In a case where the first time is changed on the basis of the summer time information, the control unit 17 prohibits outputting the second change command.

In this way, the electronic timepiece 10 according to the present embodiment can prevent the time which is displayed in the second display unit 162 from being changed by mistake, with respect to modification (for example, modification of time according to the summer time) of time which is not caused by movement to other areas.

In addition, in the present embodiment, in a case where the second time is the time corresponding to a predetermined area (for example, home area or the like) which is determined in advance, and the time (time after change) based on the time information is different from the time corresponding to the predetermined area, the control unit 17 prohibits outputting the second change command.

In this way, for example, in a case where a user continuously moves to an area other than the predetermined area (for example, home area or the like) which is determined in advance two times or more, the electronic timepiece 10 according to the present embodiment can reduce a situation in which the time corresponding to the predetermined area is not displayed in the time display unit 16. That is, the electronic timepiece 10 according to the present embodiment continuously displays the time corresponding to the predetermined area (for example, home area or the like) which is determined in advance in the time display unit 16, and thus, it is possible to increase convenience.

In addition, the electronic timepiece 10 according to the present embodiment further includes the communication unit 11 (receiving unit) which receives the time information by wireless communication, and the solar cell 181 which generates power for operating at least the communication unit 11 and the display drive unit 15.

In this way, the electronic timepiece 10 according to the present embodiment uses the solar cell 181, and thus, there is no need to change a battery.

Second Embodiment

Next, an electronic timepiece according to a second embodiment will be described with reference to the accompanying drawings.

Figure 8:
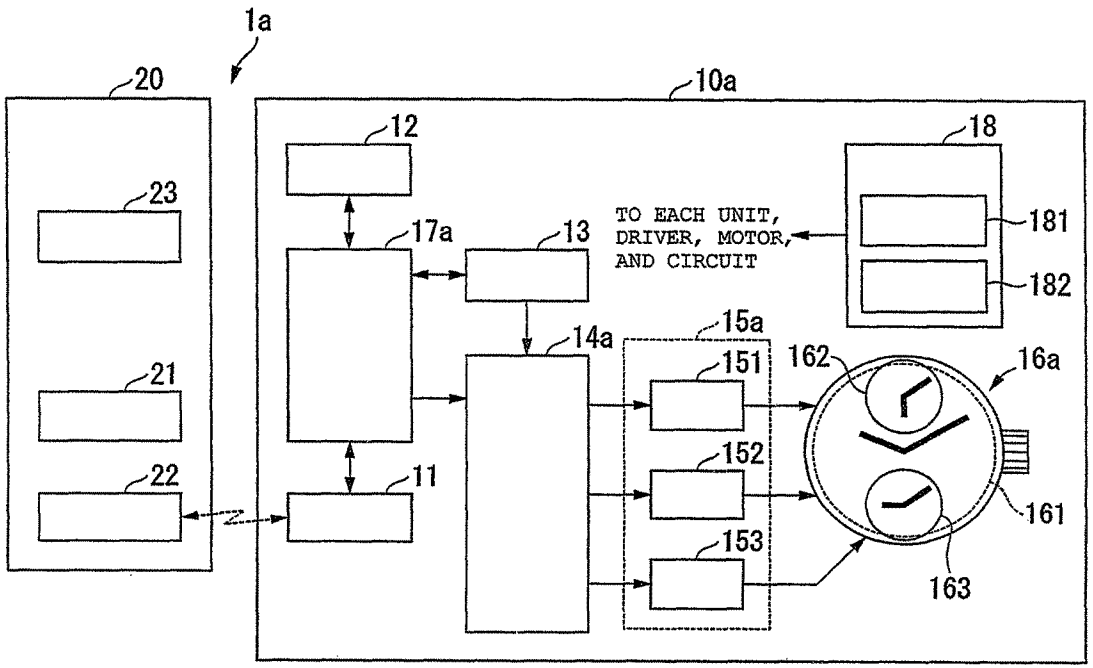
FIG. 8 is a block diagram illustrating an example of a timepiece system according to a second embodiment.

FIG. 8 is a block diagram illustrating an example of a timepiece system 1*a* according to the present embodiment.

As illustrated in FIG. 8, the timepiece system 1*a* includes an electronic timepiece 10*a* and the mobile apparatus 20.

In the present embodiment, an example of a case where the electronic timepiece 10*a* displays three times in a time display unit 16*a* will be described.

In FIG. 8, the same symbols or reference numerals are attached to the same configuration elements as those illustrated in FIG. 1, and description thereof will be omitted.

The electronic timepiece 10*a* is, for example, a timepiece such as a wristwatch, and can be connected to the mobile apparatus 20 by wireless communication. The electronic timepiece 10*a* displays three times by, for example, analog display. In addition, the electronic timepiece 10*a* includes the communication unit 11, the storage unit 12, the time measurement circuit 13, a motor driver 14*a*, a display drive unit 15*a*, a time display unit 16*a*, a control unit 17*a*, and the power supply unit 18.

The motor driver 14*a* outputs a motor drive signal which drives the display drive unit 15*a* (motors 151 to 153).

The display drive unit 15*a* performs a drive operation for advancing time which is displayed in the time display unit 16*a* or changing (modifying) time. The display drive unit 15*a* advances the time which is displayed in the time display unit 16*a*, for example, based on a drive command output from the time measurement circuit 13 to the motor driver 14*a*. In addition, the display drive unit 15*a* changes (modifies) the time which is displayed in the time display unit 16*a*, for example, based on a time change command which is output from the control unit 17*a* that will be described below to the motor driver 14*a*. In addition, the display drive unit 15*a* includes the motor 151, the motor 152, and the motor 153.

The motors 151 to 153 are, for example, stepping motors. The motor 151 advances or changes time by moving hands of the first display unit 161. In addition, the motor 152 advances or changes time by moving hands of the second display unit 162. In addition, the motor 153 advances or changes time by moving hands of a third display unit 163.

The time display unit 16*a* includes, for example, a dial and hands, and displays time by angles of the hands on the dial. In addition, the time display unit 16*a* includes the first display unit 161, the second display unit 162, and the third display unit 163 which display time.

The first display unit 161 (an example of a first time display unit) is disposed, for example, in a central portion of the time display unit 16*a*, and displays first time by angles of the hands on the dial.

The second display unit 162 (an example of a second time display unit) is disposed, for example, in an upper portion of the time display unit 16*a*, and displays second time by angles of the hands on the dial.

The third display unit 163 (an example of a third time display unit) is disposed, for example, in a lower portion of the time display unit 16*a*, and displays third time by angles of the hands on the dial.

The control unit 17*a* is a processor including, for example, a CPU or the like, and comprehensively controls the electronic timepiece 10*a*. Basic processing of the control unit 17*a* is the same as that of the control unit 17 according to the first embodiment, but in the present embodiment, the time display unit 16*a* includes the third display unit 163, and thus, processing of the third display unit 163 is different.

For example, as illustrated in FIG. 3C, in a case where a user carrying the electronic timepiece 10*a* and the mobile apparatus 20 moves from a first local area to another local area (second local area), the control unit 17*a* changes time (third time) which is displayed in the third display unit 163 into time before change which is displayed by the first display unit 161. That is, in a case where the second time is time corresponding to a predetermined area (for example, home area) and time based on time information is different from time corresponding to the predetermined area, the control unit 17*a* outputs a third change command for changing the third time which is displayed by the third display unit 163 into the time before change.

Figures 9A, 9B:
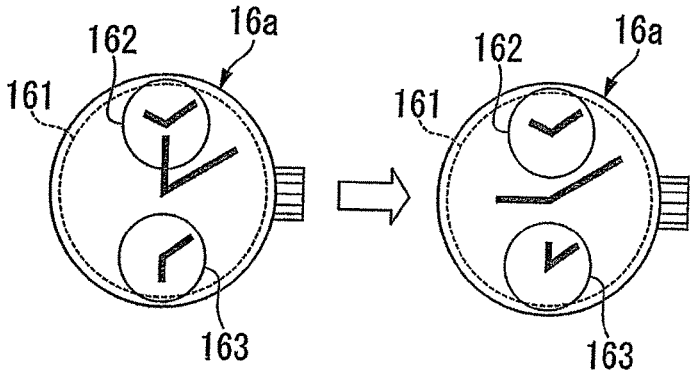
FIGS. 9A and 9B are views illustrating display examples of an electronic timepiece according to the second embodiment.

FIGS. 9A and 9B are first views illustrating display examples of the electronic timepiece 10*a* according to the present embodiment.

FIG. 9A illustrates the display example of the electronic timepiece 10*a* in a case where a user carrying the electronic timepiece 10*a* and the mobile apparatus 20 moves from a home area to a local area (first local area).

In the example illustrated in FIG. 9A, the first display unit 161 displays time of "eight minutes after twelve" corresponding to the first local area, and the second display unit 162 displays time of "eight minutes after ten" corresponding to the home area. In addition, the third display unit 163 displays time of "eight minutes after six" corresponding to other areas other than the home area.

In addition, FIG. 9B illustrates the display example of the electronic timepiece 10*a* in a case where a user carrying the electronic timepiece 10*a* and the mobile apparatus 20 moves from the first local area to another local area (second local area). In this case, the first communication unit 21 of the mobile apparatus 20 acquires time information (time information which is "eight minutes after nine" corresponding to the second local area) from a server device of a mobile phone carrier, and the apparatus control unit 23 modifies time of a timepiece function of the mobile apparatus 20 to "eight minutes after nine". Then, the apparatus control unit 23 makes the second communication unit 22 transmit a time modification command including the time information to the electronic timepiece 10*a*.

In a case where the communication unit 11 is arbitrarily set to a communicable state and thereafter receives the time modification command, the control unit 17*a* of the electronic timepiece 10*a* changes (modifies) the first time which is displayed by the first display unit 161 into time after change based on the time information. In this example, the control unit 17*a* makes the first display unit 161 of the time display unit 16*a* display time after change of "eight minutes after nine" corresponding to the second local area.

In addition, this case corresponds to a case where the second time which is displayed by the second display unit 162 is time of "eight minutes after ten" corresponding to the home area, and the time after change is different from the time corresponding to the local area. Accordingly, the control unit 17*a* makes the third display unit 163 display the time of "eight minutes after twelve" (time before change) corresponding to the aforementioned first local area. That is, the control unit 17*a* outputs the third change command for changing the third time which is displayed by the third display unit 163 into the time before change. As a result, in the time display unit 16*a*, the first display unit 161 displays the time after change of "eight minutes after nine" corresponding to the second local area, and the second display unit 162 displays the time of "eight minutes after ten" corresponding to the home area, as illustrated in FIG. 9B. In addition, the third display unit 163 displays the time of "eight minutes after twelve" corresponding to the first local area.

In this way, in the electronic timepiece 10*a* according to the present embodiment, the first time which is displayed by the first display unit 161 is automatically changed into the time corresponding to an area to which a user carrying the electronic timepiece 10*a* and the mobile apparatus 20 moves, as illustrated in FIGS. 9A and 9B. In addition, the electronic timepiece 10*a* according to the present embodiment displays the time (for example, "eight minutes after ten") corresponding to the home area (an example of a predetermined area which is determined in advance) in one of the first display unit 161 and the second display unit 162, as illustrated in FIGS. 9A and 9B. Then, the electronic timepiece 10*a* according to the present embodiment displays the time (for example, "eight minutes after twelve") corresponding to the local area (for example, the first local area) at which a user moves before moving to the current local area in the third display unit 163, as illustrated in FIGS. 9A and 9B.

As described above, in the electronic timepiece 10*a* according to the present embodiment, the time display unit 16*a* further includes the third display unit 163 (third time display unit). Then, in a case where the second time is the time corresponding to a predetermine area (for example, home area) and the time (time after change) based on the time information is different from the time corresponding to the predetermined area, the control unit 17*a* outputs the third change command for changing the third time which is displayed by the third display unit 163 into the time before change.

In this way, the electronic timepiece 10*a* according to the present embodiment can automatically change the time which is displayed by the first display unit 161 into the time corresponding to a movement destination area, without requiring an operation by the user. Then, the electronic timepiece 10*a* according to the present embodiment can simultaneously display, for example, the time (for example, "eight minutes after nine") corresponding to the movement destination area, the time (for example, "eight minutes after ten") corresponding to the home area, and the time (for example, "eight minutes after twelve") corresponding to an area immediately before the current local area. Accordingly, the electronic timepiece 10*a* according to the present embodiment can further increase convenience.

Next, a modification example of processing of the electronic timepiece 10*a* according to the second embodiment will be described with reference to FIGS. 10A to 100.

FOURTH MODIFICATION EXAMPLE

Figures 10A, 10B, 10C:
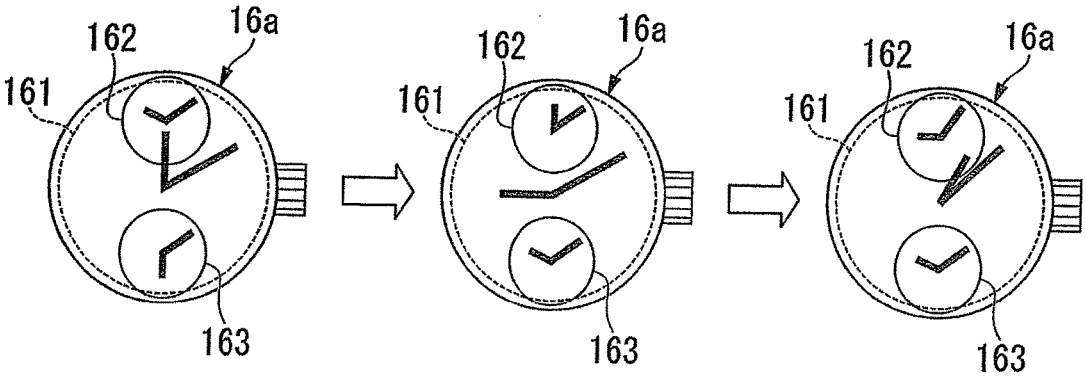
FIGS. 10A to 10C are views illustrating display examples of an electronic timepiece according to a modification example (fourth modification example) of the second embodiment.

FIGS. 10A to 10C are views illustrating display examples of an electronic timepiece 10*a* according to a fourth modification example of the second embodiment.

FIG. 10A illustrates the display example of the electronic timepiece 10*a* in a case where a user carrying the electronic timepiece 10*a* and the mobile apparatus 20 moves from the home area to a local area (first local area).

In the example illustrated in FIG. 10A, the first display unit 161 displays time of "eight minutes after twelve"

corresponding to the first local area, and the second display unit 162 displays time of "eight minutes after ten" corresponding to the home area. In addition, the third display unit 163 displays time of "eight minutes after six" corresponding to other areas other than the home area.

In addition, FIG. 10B illustrates the display example of the electronic timepiece 10*a* in a case where a user carrying the electronic timepiece 10*a* and the mobile apparatus 20 moves from the first local area to another local area (second local area). In this case, the first communication unit 21 of the mobile apparatus 20 acquires time information (time information which is "eight minutes after nine" corresponding to the second local area) from a server device of a mobile phone carrier, and the apparatus control unit 23 modifies time of a time function of the mobile apparatus 20 to "eight minutes after nine". Then, the apparatus control unit 23 makes the second communication unit 22 transmit a time modification command including the time information to the electronic timepiece 10*a*.

In a case where the communication unit 11 is arbitrarily set to a communicable state and thereafter receives the time modification command, the control unit 17*a* of the electronic timepiece 10*a* changes (modifies) the first time which is displayed by the first display unit 161 into time after change based on the time information. In this example, the control unit 17*a* makes the first display unit 161 of the time display unit 16*a* display time after change of "eight minutes after nine" corresponding to the second local area.

In addition, the control unit 17*a* displays the time of "eight minutes after twelve" (time before change) corresponding to the aforementioned first local area in the second display unit 162, and displays the time of "eight minutes after ten" which is displayed by the second display unit 162 and corresponds to the home area in the third display unit 163. That is, the control unit 17*a* outputs the second change command for changing the second time which is displayed by the second display unit 162 into the time before change, and outputs the third change command for changing the third time that is displayed by the third display unit 163 into the time corresponding to the home area which is displayed by the second display unit 162. As a result, in the time display unit 16*a*, the first display unit 161 displays the time after change of "eight minutes after nine" corresponding to the second local area, and the second display unit 162 displays the time of "eight minutes after twelve" corresponding to the first local area, as illustrated in FIG. 10B. In addition, the third display unit 163 displays the time of "eight minutes after ten" corresponding to the home area.

In addition, FIG. 10*c* illustrates the display example of the electronic timepiece 10*a* in a case where a user carrying the electronic timepiece 10*a* and the mobile apparatus 20 moves from the second local area to another local area (third local area). In this case, the first communication unit 21 of the mobile apparatus 20 acquires time information (time information which is "eight minutes after one" corresponding to the second local area) from a server device of a mobile phone carrier, and the apparatus control unit 23 modifies time of the timepiece function of the mobile apparatus 20 to "eight minutes after one". Then, the apparatus control unit 23 commands the second communication unit 22 to transmit a time modification command including the time information to the electronic timepiece 10*a*.

In a case where the communication unit 11 is arbitrarily set to a communicable state and thereafter receives the time modification command, the control unit 17*a* of the electronic timepiece 10*a* changes (modifies) the first time which is displayed by the first display unit 161 into time after change based on the time information. In this example, the control unit 17*a* makes the first display unit 161 of the time display unit 16*a* display time after change of "eight minutes after one" corresponding to the third local area. That is, the control unit 17*a* outputs the first change command for changing the first time which is displayed by the first display unit 161 into the time after change corresponding to the third local area.

In addition, the control unit 17*a* displays the time of "eight minutes after nine" (time before change) corresponding to the aforementioned second local area in the second display unit 162. In addition, the control unit 17*a* does not display the time of "eight minutes after twelve" corresponding to the first local area which is displayed by the second display unit 162 in the third display unit 163, and maintains that the time of "eight minutes after ten" corresponding to the home area is displayed in the third display unit 163. That is, the control unit 17*a* outputs the second change command for changing the second time that is displayed by the second display unit 162 into the time before change, and does not output the third change command for changing the third time which is displayed by the third display unit 163. As a result, in the time display unit 16*a*, the first display unit 161 displays the time after change of "eight minutes after one" corresponding to the third local area, and the second display unit 162 displays the time of "eight minutes after nine" corresponding to the second local area, as illustrated in FIG. 10C. In addition, the third display unit 163 displays the time of "eight minutes after ten" corresponding to the home area.

As described above, in the electronic timepiece 10*a* according to the present modification example, the first time which is displayed by the first display unit 161 is automatically changed into the time corresponding to an area to which a user carrying the electronic timepiece 10*a* and the mobile apparatus 20 moves, as illustrated in FIGS. 10A to 10C. In addition, the electronic timepiece 10*a* according to the present embodiment displays the time (for example, "eight minutes after ten") corresponding to the home area (an example of a predetermined area which is determined in advance) in any one of the first display unit 161, the second display unit 162, and the third display unit 163, as illustrated in FIGS. 10A to 10C.

In this way, the electronic timepiece 10*a* according to the present modification example can automatically change the time which is displayed by the first display unit 161 into the time corresponding to a movement destination area, without requiring an operation by the user. Then, the electronic timepiece 10*a* according to the present embodiment can simultaneously display, for example, the time (for example, "eight minutes after one") corresponding to the movement destination area, the time (for example, "eight minutes after nine") corresponding to an area immediately before the current local area, and the time (for example, "eight minutes after ten") corresponding to the home area. Accordingly, the electronic timepiece 10*a* according to the present embodiment can further increase convenience.

Third Embodiment

Next, an electronic timepiece according to a third embodiment will be described with reference to the accompanying drawings.

Figure 11:
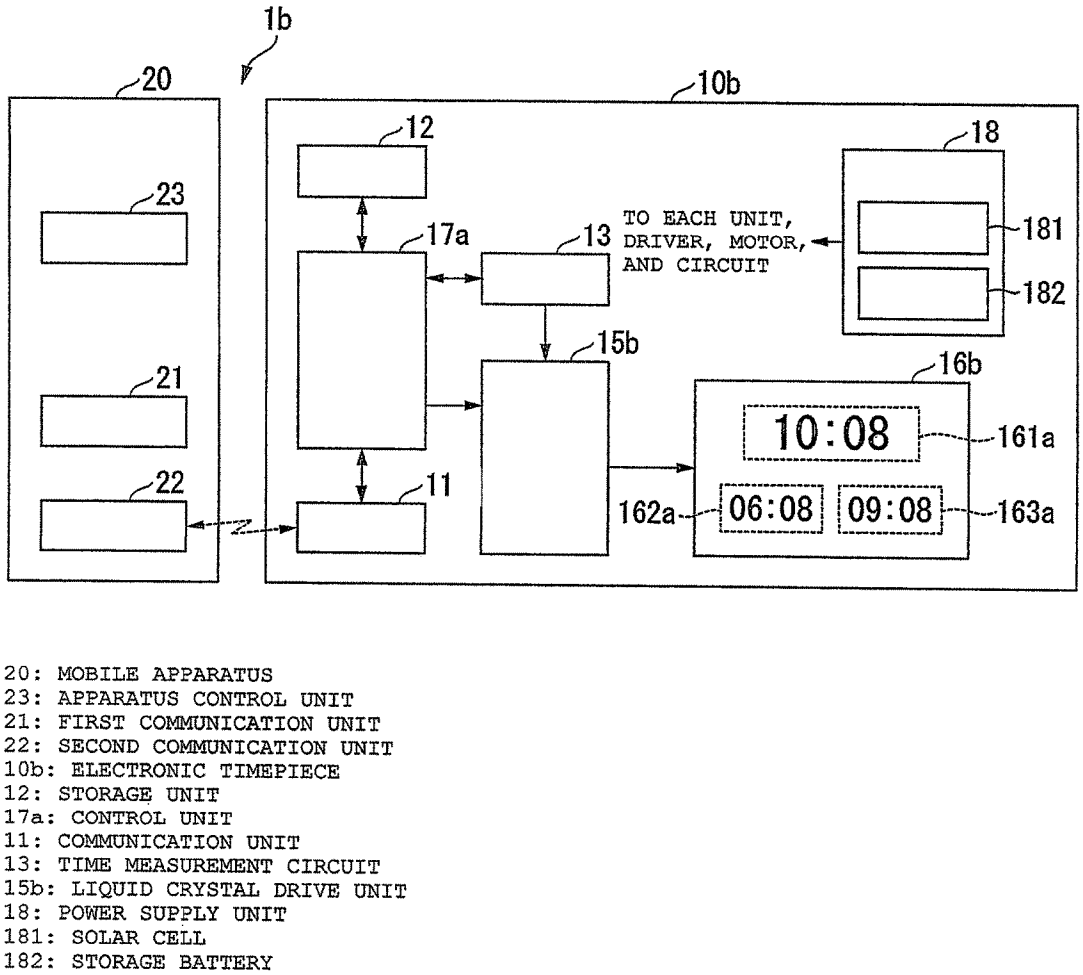
FIG. 11 is a block diagram illustrating an example of a timepiece system according to a third embodiment.

FIG. 11 is a block diagram illustrating an example of a timepiece system 1*b* according to the present embodiment.

As illustrated in FIG. 11, the time piece system 1*b* includes an electronic timepiece 10*b* and the mobile apparatus 20.

In the present embodiment, an example of a case where the electronic timepiece 10*b* includes a time display unit 16*b* which displays time by digital display will be described.

In FIG. 11, the same symbols or reference numerals are attached to the same configuration elements as those illustrated in FIG. 8, and description thereof will be omitted.

The electronic timepiece 10*b* is, for example, a timepiece such as a wristwatch, and can be connected to the mobile apparatus 20 by wireless communication. The electronic timepiece 10*b* displays three times by, for example, digital display. In addition, the electronic timepiece 10*b* includes the communication unit 11, the storage unit 12, the time measurement circuit 13, a liquid crystal drive unit 15*b*, the time display unit 16*b*, the control unit 17*a*, and the power supply unit 18.

The time display unit 16*b* includes, for example, a liquid crystal display, and displays time by digital display. In addition, the time display unit 16*b* includes a first display unit 161*a*, a second display unit 162*a*, and a third display unit 163*a* which display time.

The first display unit 161*a* (an example of a first time display unit) is disposed, for example, in a central portion of the time display unit 16*b*, and displays first time by digital display.

The second display unit 162*a* (an example of a second time display unit) is disposed, for example, in a lower left portion of the time display unit 16*b*, and displays second time by digital display.

The third display unit 163*a* (an example of a third time display unit) is disposed, for example, in a lower right portion of the time display unit 16*b*, and displays third time by digital display.

The liquid crystal drive unit 15*b* (an example of a display drive unit) outputs a drive signal which drives the time display unit 16*b* including a liquid crystal display, and performs a drive operation of the time display unit 16*b*. The liquid crystal drive unit 15*b* performs the drive operation for advancing the time which is displayed in the time display unit 16*b*, or changing (modifying) the time. The liquid crystal drive unit 15*b* advances the time which is displayed in the time display unit 16*b*, for example, based on the drive command which is output from the time measurement circuit 13. In addition, the liquid crystal drive unit 15*b* changes (modifies) the time which is displayed in the time display unit 16*b*, for example, based on the time change command which is output from the control unit 17*a*.

The time measurement circuit 13 according to the present embodiment measures time, and outputs the drive command to advance time which is displayed in the time display unit 16*b* to the liquid crystal drive unit 15*b*.

In addition, the control unit 17*a* according to the present embodiment outputs the first change command, the second change command, and the third change command to the liquid crystal drive unit 15*b*.

As described above, the electronic timepiece 10*b* according to the present embodiment includes the time display unit 16*b* including a liquid crystal display, the liquid crystal drive unit 15*b* (display drive unit) which changes the time that is displayed in the time display unit 16*b*, and the aforementioned control unit 17*a*.

Accordingly, the electronic timepiece 10*b* according to the present embodiment obtains the same effects as in the second embodiment. That is, the electronic timepiece 10*b* according to the present embodiment can increase convenience in the same manner as in the second embodiment.

The invention is not limited to the respective embodiments described above, and can be modified in a range without departing from the gist of the invention.

For example, in the above-described embodiments, examples in which the time display unit 16 (16*a*, 16*b*) displays two times or three times are described, but the invention is not limited to these. The time display unit 16 (16*a*, 16*b*) may display, for example, four times or more.

In addition, in the respective embodiments described above, an example in a case where the time information is information indicating the time after modification is described, but the invention is not limited to this. For example, if the time information is time-countable (creatable) information such as time zone information or positional information, the time information may be other information. For example, in a case where the time information is the time zone information, the control unit 17 (17*a*) generates time after change based on the time zone information.

In addition, in the respective embodiments described above, an example in which the electronic timepiece 10 (10*a*, 10*b*) receives the time information from the mobile apparatus 20 is described, but the invention is not limited to this. The electronic timepiece 10 (10*a*, 10*b*) may receive the time information from, for example, a transmission station of a radio wave timepiece or an artificial satellite of a global positioning system (GPS) through the communication unit 11. In addition, in a case where the communication unit 11 performs wireless communication through wireless LAN, the electronic timepiece 10 may receive the time information from a time server on a network.

In addition, in the respective embodiments described above, an example in which the mobile apparatus 20 is a mobile phone such as smart phone is described, but the invention is not limited to this, and the mobile apparatus 20 may be, for example, a computer device such as a personal computer, a personal digital assistant (PDA), a tablet terminal, or the like.

In addition, in the respective embodiments described above, an example in which the electronic timepiece 10 (10*a*, 10*b*) is a timepiece such as a wristwatch is described, but the electronic timepiece 10 may be an electronic apparatus (a mobile phone such as, a wearable terminal or a smart phone) with a timepiece function, or the like. In addition, in a case where the electronic timepiece 10 (10*a*, 10*b*) is an electronic apparatus with a timepiece function, the electronic timepiece 10 (10*a*, 10*b*) may be realized by executing, for example, an application program of a timepiece function.

Each configuration unit included in the aforementioned timepiece system 1 (1*a*, 1*b*) includes a computer system therein. Then, processing of each configuration unit included in the aforementioned timepiece system 1 (1*a*, 1*b*) may be performed by recording a program for realizing a function of each configuration unit included in the aforementioned timepiece system 1 (1*a*, 1*b*) in a computer-readable recording medium, reading the program recorded in the recording medium into a computer system, and executing the program which is read. Here, "reading the program recorded in the recording medium to the computer system and executing the program" includes installing the program into the computer system. Here, it is assumed that the "computer system" includes OS or hardware such as a peripheral apparatus.

In addition, the "computer system" may include multiple computer devices which are connected to each other through a network including communication lines such as Internet, WAN, LAN, or dedicated lines. In addition, the "computer-readable recording medium" includes a portable medium such as a flexible disk, a magneto-optical disk, a ROM, or a CD-ROM, and a storage device such as a hard disk which is embedded in a computer system. In this way, a recording medium in which a program is stored may be a non-transient recording medium such as a CD-ROM.

In addition, the recording medium also includes a recording medium which is provided internally or externally and is accessible from a delivery server that delivers the program. A configuration in which a program is divided into multiple programs and the multiple programs are downloaded at timing different from each other and the downloaded programs are combined by each configuration unit included in the timepiece system 1 (1*a*, 1*b*), or a delivery server which delivers each of the divided programs may be different. Furthermore, the "computer-readable recording medium" may include a device which retains the program for a predetermined time, such as a server in a case where the program is transmitted through a network, or a volatile memory (RAM) in a computer system which becomes a client. In addition, the aforementioned program may realize a part of the aforementioned functions. Furthermore, the program may be realized by combining the aforementioned function with a program recorded in advance in the computer system, or may be a so-called differential file (differential program).

In addition, a part or the entirety of the aforementioned functions may be realized as an integrated circuit such as large scale integration (LSI). The aforementioned respective functions may be configured by an individual processor, and a part or the entirety of the functions may be integrated to configure a processor. In addition, a method of configuring an integrated circuit is not limited to LSI, and may be performed by a dedicated circuit or a general processor. In addition, in a case where a technology of producing an integrated circuit replacing the LSI is generated as a semiconductor technology advances, an integrated circuit produced by using the technology may be used.

What is claimed is:

1. An electronic timepiece comprising:

a time display unit having a first time display unit that displays a first time and a second time display unit that displays a second time;

a receiving unit configured to receive a time modification command including time information for modifying the first time displayed by the first time display unit;

a control unit configured to output a first change command for automatically changing the first time that is displayed by the first time display unit into a modified time different from the second time displayed by the second time display unit based on the time information received by the receiving unit, and configured to output a second change command for changing the second time that is displayed by the second time display unit into the first time that is displayed by the first time display unit before the first time is changed into the modified time based on the time information received by the receiving unit; and a display drive unit configured to change the first time based on the first change command that is output from the control unit, and configured to change the second time based on the second change command that is output from the control unit.

2. The electronic timepiece according to claim 1, wherein the control unit outputs the second change command in a case where the first change command is caused by movement to other areas, and prohibits outputting the second change command in a case where the first change command is not caused by movement to other areas.

3. The electronic timepiece according to claim 1, wherein the control unit prohibits outputting the second change command, in a case where a difference between the modified time based on the time information received by the receiving unit and the first time that is displayed by the first time display unit before the first time is changed into the modified time is equal to or lower than a predetermined value.

4. The electronic timepiece according to claim 1, wherein time zone information indicating an area in which common standard time is used is included in the time information received by the receiving unit, and wherein the control unit prohibits outputting the second change command, in a case where the received time zone information is the same as the previously received time zone information.

5. The electronic timepiece according to claim 1, wherein summer time information on a change of standard time corresponding to a season is included in the time information received by the receiving unit, and wherein the control unit prohibits outputting the second change command, in a case where the first time is changed on the basis of the summer time information.

6. The electronic timepiece according to claim 1, wherein the control unit prohibits outputting the second change command, in a case where the second time is time corresponding to a predetermined area which is determined in advance, and the time based on the time information received by the receiving unit is different from time corresponding to the predetermined area.

7. The electronic timepiece according to claim 6, wherein the time display unit further includes a third time display unit, and wherein the control unit outputs a third change command for changing third time which is displayed by the third time display unit into the first time that is displayed by the first time display unit before the first time is changed into the modified time, in a case where the second time is time corresponding to the predetermined area and the time based on the time information received by the receiving unit is different from the time corresponding to the predetermined area.

8. The electronic timepiece according to claim 1, wherein the receiving unit is configured to receive the time information by wireless communication; and further comprising a solar cell configured to generate power for operating at least the receiving unit and the display drive unit.

9. A computer-readable non-transitory recording medium for recording a program readable by a computer serving as an electronic timepiece including a time display unit which includes a first time display unit that displays a first time and a second time display unit that displays a second time, and a display drive unit which changes time that is displayed in the time display unit, the program controlling the electronic timepiece to:

receive a time modification command including time information for modifying the first time displayed by the first time display unit;

output a first change command for automatically changing the first time that is displayed by the first time display unit into a modified time different from the second time displayed by the second time display unit based on the received time information;

output a second change command for changing the second time that is displayed by the second time display unit into the first time that is displayed by the first time display unit before the first time is changed into the modified time based on the received time information; and cause the display drive unit to change the first time based on the first change command and to change the second time based on the second change command.

10. An electronic timepiece for displaying times corresponding to different areas when moving the timepiece to the different areas, the electronic timepiece comprising:

a time display unit having a first display unit configured to display a time corresponding to a first area and a second display unit configured to display a time corresponding to a second area different from the first area;

a receiving unit configured to receive a time modification command including time information for modifying the time displayed by the first display unit;

a control unit configured to output a first change command for automatically changing the time displayed by the first display unit into a modified time corresponding to a third area different from the time corresponding to the second area based on the time information received by the receiving unit, and configured to output a second change command for changing the time displayed by the second display unit into the time corresponding to the first area; and a display drive unit configured to change the time displayed by the first display unit into the modified time based on the first change command from the control unit, and configured to change the time displayed by the second display unit based on the second change command from the control unit.

11. The electronic timepiece according to claim 10, wherein the control unit is configured to prohibit outputting the second change command in a case where a difference between the modified time corresponding to the third area and the time corresponding to the first area is equal to or lower than a predetermined value.

12. The electronic timepiece according to claim 10, wherein the control unit is configured to prohibit outputting the second change command in a case where the modified time corresponding to the third area is the same as the time corresponding to the first area.

13. The electronic timepiece according to claim 10, wherein the receiving unit is configured to receive the time information by wireless communication; and further comprising a solar cell configured to generate power for operating at least the receiving unit and the display drive unit.

* * * * *